US005117238A

United States Patent [19]

Silverstein et al.

[11] Patent Number: 5,117,238

[45] Date of Patent: May 26, 1992

[54] SUPERRESOLUTION BEAMFORMER FOR LARGE ORDER PHASED ARRAY SYSTEM

[75] Inventors: Seth D. Silverstein, Schenectady; William E. Engeler, Scotia, both of N.Y.

[73] Assignee: General Electric Company, Schenectady, N.Y.

[21] Appl. No.: 656,882

[22] Filed: Feb. 19, 1991

[51] Int. Cl.[5] ..... H01Q 3/22; H01Q 3/24; H01Q 3/26

[52] U.S. Cl. ..... 342/373; 342/196

[58] Field of Search ..... 342/373, 192, 196; 324/77 G, 77 B

[56] References Cited

U.S. PATENT DOCUMENTS 4,112,430 9/1978 Ladstatter .

OTHER PUBLICATIONS

R. O. Schmidt, "Multiple Emitter Location and Signal Parameter Estimation", IEEE Trans. Antennas and Propagation, Mar. 1986, vol. AP-34, pp. 276-280.

R. Roy, A. Paulraj, and T. Kailath, ESPRIT-"A Subspace Rotation Approach to Estimation of Parameters of Cisoids in Noise", IEEE Trans. on ASSP, Oct. 1986, vol. 34, pp. 1340-1342.

S. D. Silverstein and J. M. Pimbley, "Robust Spectral Estimation: Autocorrelation Based Minimum Free Energy Method", Proc. 22nd Asilomar Conference on Signals, Systems and Computers, Nov. 1988.

D. W. Tufts and R. Kumaresan, "Estimation of Frequencies of Multiple Sinusoids: Making Linear Prediction Perform Like Maximum Likelihood", Proc. IEEE, Sep. 1982, vol. 70, pp. 975-989.

S. D. Silverstein, S. M. Carroll and J. M. Pimbley, "Performance Comparisons of the Minimum Free Energy Algorithms with the Reduced Rank Modified Covariance Eigenanlysis Algorithm", Proc. ICASSP, Glascow, Scotland, U.K. May 1989.

R. W. Schafer and L. R. Rabiner, "A Digital Signal Processing Approach to Interpolation", Proc. IEEE, Jun. 1973, vol. 61, pp. 692-702.

*Primary Examiner*—Theodore M. Blum

*Attorney, Agent, or Firm*—Lawrence P. Zale; James C. Davis, Jr.; Marvin Snyder

[57] ABSTRACT

Parallel architectures preprocesses large matrices from digital phased array systems, receiving signals from distant sources, to produce lower order matrices, called pseudo coherent apertures, which are computationally less burdensome. The large matrices are processed by frequency shifting, low pass filtering with an FIR filter, and executing front-end decimation to create the pseudo coherent apertures, each corresponding to different sectors of the spatial frequency spectrum. The pseudo coherent apertures are processed using matrix based superresolution spectral estimation algorithms such as the Tufts-Kumaresan (T-K) reduced rank modified covariance algorithm and the Linear Minimum Free Energy algorithms produce an image of the sources.

9 Claims, 14 Drawing Sheets

SUPERRESOLUTION BEAMFORMER FOR LARGE ORDER PHASED ARRAY SYSTEM

CROSS REFERENCES TO RELATED APPLICATIONS

Reference is made to related application "A MULTI-RATE SUPERRESOLUTION TIME SERIES SPECTRUM ANALYZER", William Ernest Engeler, and Seth David Silverstein, Docket No. RD-19,737 filed simultaneously with this application, and also assigned to the present assignee.

BACKGROUND OF THE INVENTION

1. Field of the Invention

The present invention relates to a digital phased array system and more specifically to digital phased array system parallel architectures for superresolution beamformers.

2 Description of Related Art

Digital phased array systems employ a number of sensors employed over a surface area. At any given instant, information from the phased array can be represented by a large data vector. The large data vectors are accumulated in large order matrix arrays that are manipulated in order to produce solutions. In the case of a radar or sonar system, the solution can be represented by an image which is reconstructed on the display screen. In order to produce finer resolution, a greater number of sensors are used. This results in the larger size matrix arrays to be solved. The computation time required to implement superresolution beamforming with an array of x sensors is usually proportional to $x^3$. This means that doubling the number of sensors increases the computation by a factor of eight.

There are a number of techniques which are used to avoid large matrix problems. Unfortunately, most of these approaches compromise the potential system resolution. An example would be the division of a large phased array into non-overlapping smaller phased arrays. These subarrays are represented by small matrix arrays, each with sample orders that are small enough to make matrix operations feasible. However, this procedure reduces the Rayleigh resolution to that of the shorter length sub-apertures corresponding to the smaller matrix arrays. (The Rayleigh angular resolution is defined as the carrier wavelength divided by the physical length of the aperture.)

Another technique involves autoregressive parametric analysis. This involves the reduction of the order of parametric models to levels small enough to suppress instabilities. The arithmetic instabilities which are manifested in spurious peaks are caused by large noise-induced fluctuations in the small eigenvalues of the autocorrelation matrices. These methods also significantly degrade resolution.

The problem to be solved is to obtain high, sub-Rayleigh image resolution at moderately low SNR scenarios for phased arrays when the order of the array is too large for the matrix based superresolution methods to be practicable. Here the number of elements in the phased array represent both the order of the array and also the order of the covariance matrices which are computed from the complex elemental data.

There is an extensive prior art associated with multirate signal processing architectures as they apply to voice coding (See "A Digital Signal Processing Approach to Interpolation", R.W. Schafer and L.R. Rabiner, *Proc. IEEE*, Vol. 61, pp. 692–702, Jun. 1973). The generic architecture for the multirate preprocessor of the superresolution systems consists of sequential operations involving the combination of filtering, base band modulation, and decimation which provides a division of the spatial spectrum (often referred to as beam space) into spatial spectral subbands, called sectors. Different architectures which basically accomplish the same end effect correspond to permutations of the order of the signal processing operations.

Superresolution algorithms are the class of algorithms which produce effective pencil beams (angular resolution) which, on the average, are of sub-Rayleigh resolution. Superresolution is often expedited using some form of a matrix approach based upon covariance matrices computed from the elemental complex data for the sampled phased array. Difficulties often occur when the order of the matrices are large, say greater than ~32. Large matrices are computationally burdensome, and moreover are susceptible to instability problems associated with potential ill-conditioning.

There is a need for an architecture that employs spatial spectral subbanding techniques for the specific purpose of creating effective lower element order pseudo-arrays which can be processed in parallel in a matrix based superresolution algorithms without sacrificing resolution.

SUMMARY OF THE INVENTION

A superresolution beamformer of the type set forth in this invention that is used for preprocessing coherent aperture data employs a number of parallel branches, each branch having a modulator, a low pass filter, a decimator, and an output. The modulator in each branch receives the data from the coherent aperture and shifts the signal by a predetermined value which differs for each branch. The output of each modulator is low pass filtered, and then the number of samples is reduced by its corresponding decimation. The output of each branch is then sent to a plurality of superresolution analyzers used in reconstructing the signal from the coherent aperture.

The present invention employs spatial spectral subbanding techniques for creating lower element order arrays, called pseudo-arrays that can be processed to give the spatial spectrums in commensurate angular sectors. The pseudo-arrays are created from the signal sent from a digital phased array by executing single sideband modulation of the spatial spectrum, low pass filtering, and decimation. The parallel architecture of the present invention preserves the potential resolution of the full coherent aperture while making superresolution techniques practicable. In an alternate embodiment of the present invention, modulation is performed after low pass filtering and decimating. In still another embodiment, a windowing element and Fast Fourier Transform (FFT) perform the low pass filtering, and decimation is produced by selectively passing the outputs of the FFT element to a number of Inverse FFT elements, with the Inverse FFT elements performing the demodulation of the signal. The use of additional windowing elements produces the presently preferred embodiment of the invention.

OBJECTS OF THE INVENTION

It is an object of the present invention to provide a means for dividing an array matrix representing a large order phased array into a series of smaller matrix arrays each representing angular sectors of the imaging field of the large order phase array. The sectors can be either contiguous, or preferentially arranged with overlap to eliminate end effects at sector boundaries. The individual pseudo-arrays representing the angular sectors can all be processed in parallel.

It is another object of the present invention to provide a means for dividing a long coherent phased array into many effective pseudo-arrays with orders which are small enough to make the matrix analyses feasible.

It is an another object of the present invention to provide a means for achieving the effective replacement of single sampled large order phased array by a number of pseudo phased arrays each of which have the same effective overall spatial extent of the original large phased array but have sample orders sufficiently reduced to make the necessary matrix operations practicable, each pseudo phased array corresponding to a different sector of the spatial frequency spectrum.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings(s) in which:

DETAILED DESCRIPTION OF THE PREFERRED EMBODIMENT

U.S. Pat. No.4,982,150 Silverstein and Pimbley issued Jan. 1, 1991, assigned to the present assignee, is hereby incorporated by reference and made part of this disclosure.

The present invention employs parallel architectures for implementing matrix based superresolution spectral estimation algorithms for situations that require high levels of resolution commensurate with large coherent apertures and large sample orders. Algorithms involving large order matrices are computationally burdensome and often suffer from stability problems associated with ill-conditioning. The parallel architectures of the present invention preserves the potential Rayleigh resolution of the full aperture, and reduce matrix orders to levels where calculations are feasible.

Figure 3A:
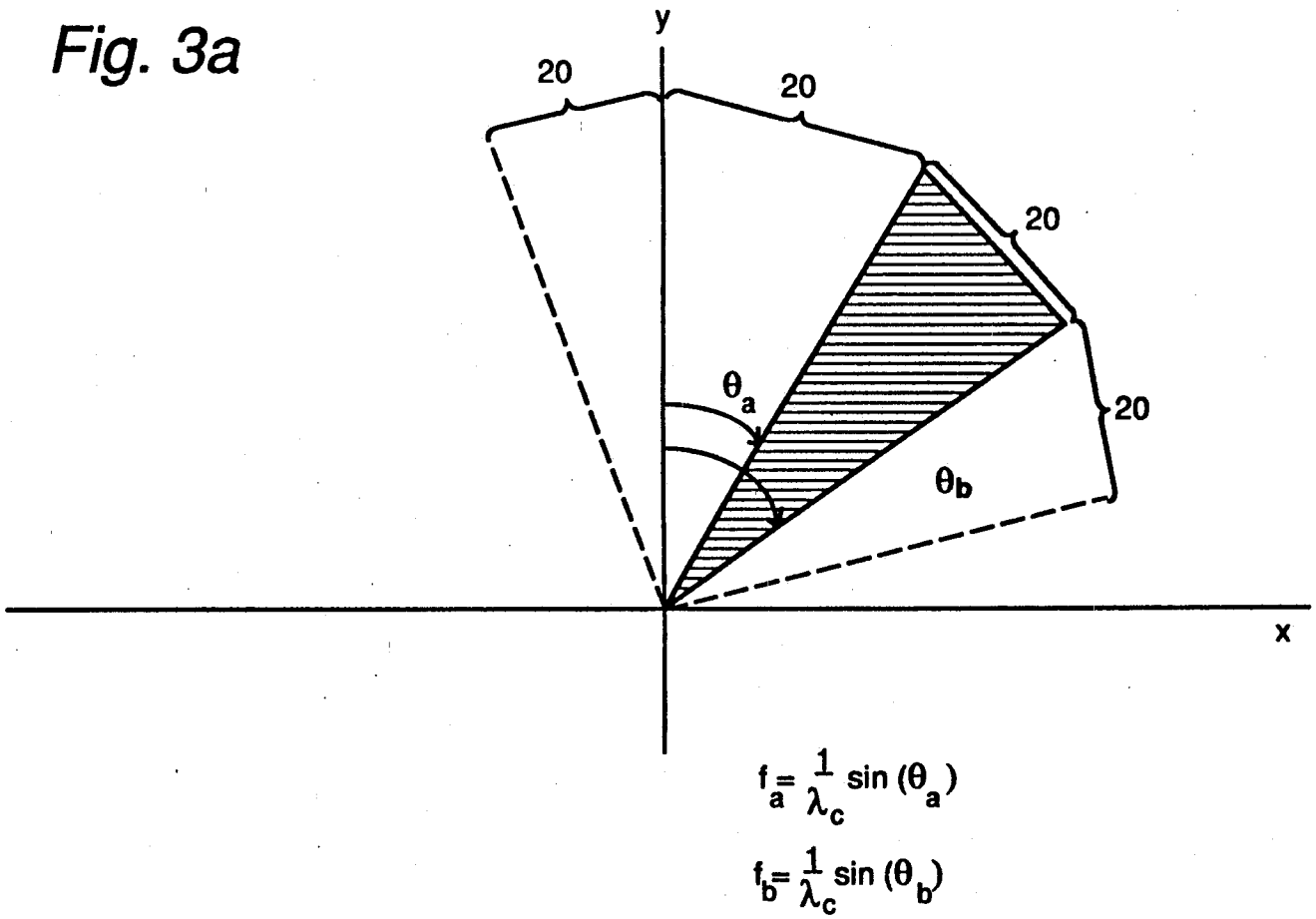
FIG. 3*a* illustrates an angular sector contained within the direction of arrival angles $\theta_a$, $\theta_b$ corresponding to the spatial frequencies $f_a$, $f_b$. The sector has spatial frequency width $(f_b-f_a)$.

The architectures of the present invention are based upon an application of the sampling theorem to spatial phased arrays. Consider a signal that encompasses an angular sector from $[\theta_a, \theta_b]$as shown in FIG. 3*a*. This angular sector will encompass spatial frequencies f defined as $1/\lambda c \sin\theta$ from $[f_a, f_b]$, where $\lambda_c$ represents the central wavelength of the signal used in the imaging, $\theta_a$, $\theta_b$ are the angles measured from an axis perpendicular to the linear phased array. To prevent aliasing in the form of grating sidelobes, a signal of spatial baseband bandwidth B, $(f_b-f_a)$, must be sampled after modulation so the central frequency coincides with zero at a rate greater than the Nyquist rate for the spatial system. This corresponds to the requirement that the spatial sampling rate, which is equal to the reciprocal of the element spacing $\delta$, must be greater than the spatial bandwidth. That is, $1/\delta \geqq B$. For example, for a signal coming from a sector encompassing the angles from $-45°$, $+45°$, the interval spacing $\delta$ must be less than or equal to $\pi c \sqrt{2}$. Note that $\delta = f_{a-fb}$.

The system is designed specifically to obtain sub-Rayleigh spatial resolution from elemental in phase and quadrature data obtained from sampled coherent apertures which involve relatively large numbers of individual array elements. The present invention provides parallel system architecture that allows the implementation of the matrix based superresolution algorithms even though the order of the coherent aperture, phased array systems are too large for the matrix based superresolution algorithms to be practicable.

Figure 1:
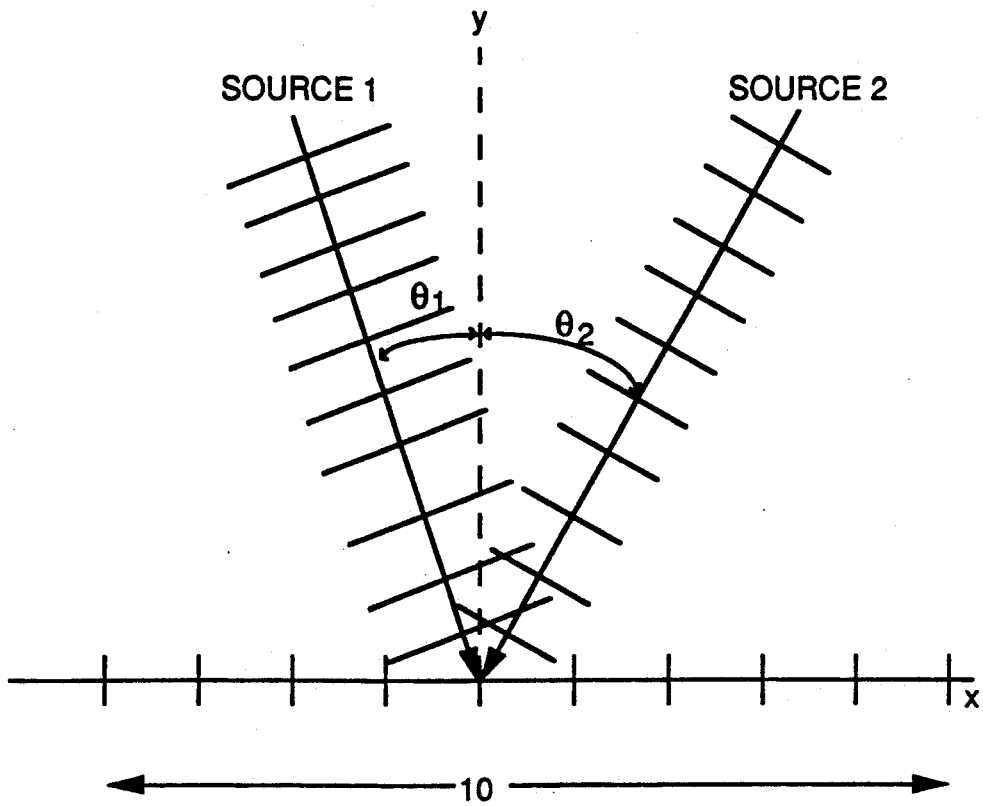
FIG. 1 illustrates the relationship between the direction of arrival angles for sources 1 and 2 represented by $\theta_1$, $\theta_2$ and the array.
Figure 2:
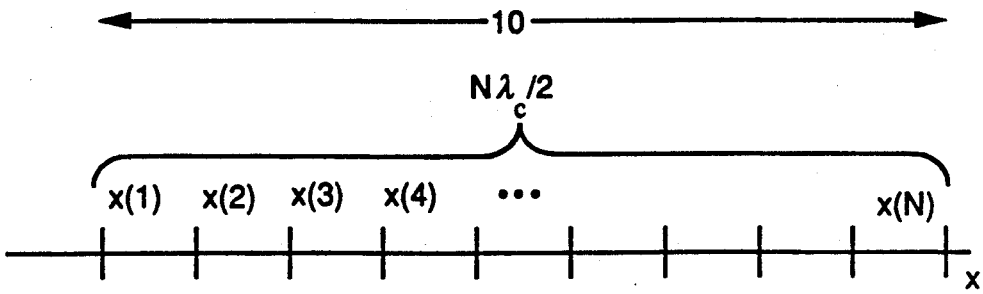
FIG. 2 illustrates sampling of a large coherent aperture where x(1), ... x(N) represent the signals at the elements of the array at a specific time.

Consider a uniformly sampled coherent aperture 10 consisting of N complex samples, {x(n)}, where n is the index number of the signal sample, each separated by $\lambda_c/2$ as shown in FIG. 2. The signal from the coherent aperture 10 is sampled to produce a large array 10 represented by samples x(n). The total length of the coherent aperture 10 is $N\lambda_c/2$, and the Rayleigh angular resolution is 2/N.

By filtering, the spectrum can be divided up into K sectors of equal bandwidth. The filtering operation gives K sets of signals {y1(n)} (all of order N). The sectors can be decimated from N to N/K=Q samples. The decimated pseudo phased arrays which describe the sector spectra are uniformly sampled with sampling intervals equal $\lambda_c K/2$. Each of the pseudo phased arrays cover the same total length as the original coherent aperture 10, $\lambda_c KQ/2 = \lambda_c N/2$, which implies that the sector Rayleigh resolution is unchanged from that of the original large phased array. All these processes are performed in parallel on each of the sectors and the results fed in parallel into a bank of superresolution processors. These pseudo phased arrays now have sample orders that are sufficiently reduced to make the necessary matrix operations practicable.

Figure 4:
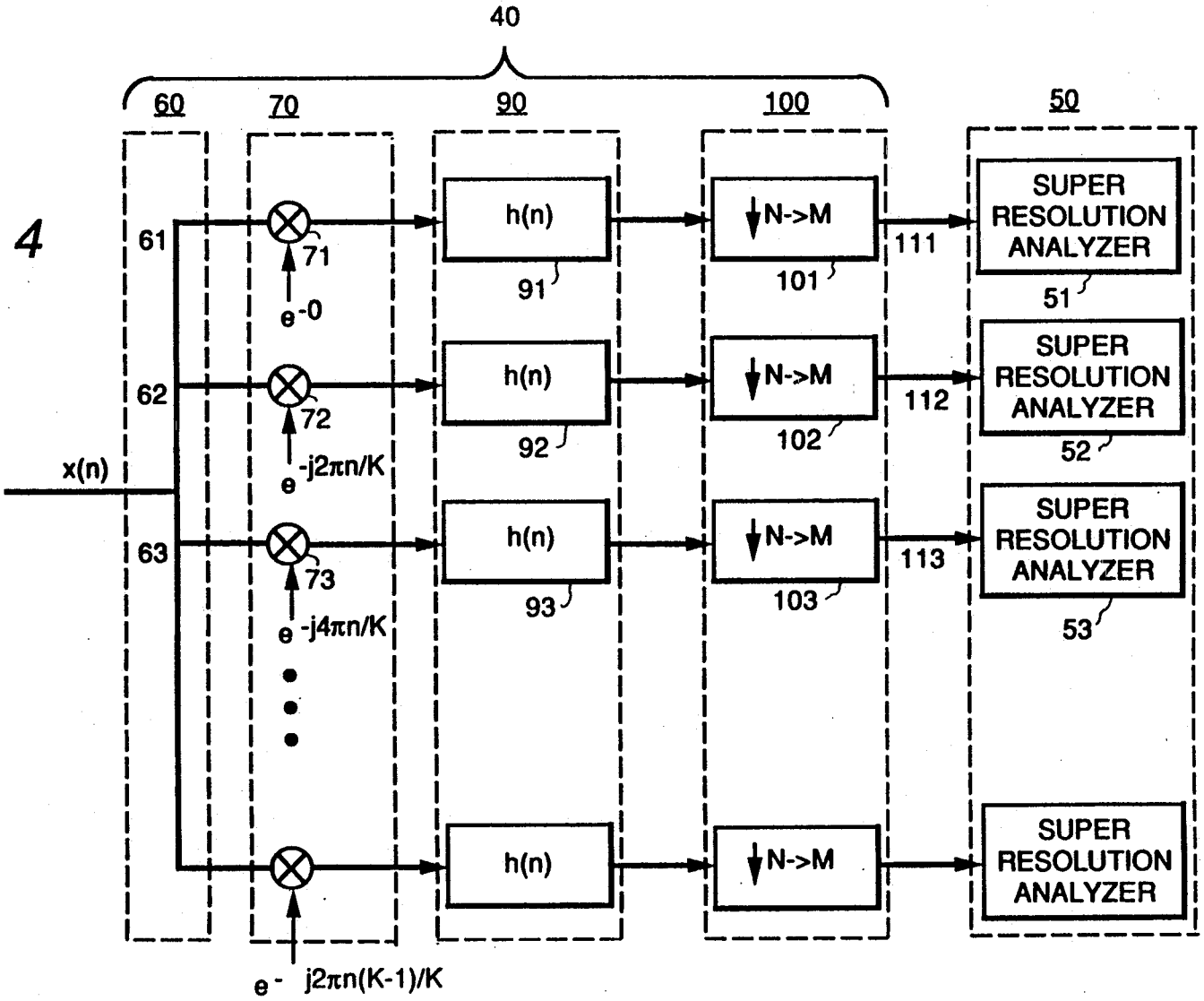
FIG. 4 is a partial block diagram of a first embodiment of the present invention.

FIG. 4 shows the large array of N complex samples x(n) being fed to the present invention having two subsystems consisting of a front-end processor stage 40 and a superresolution processor stage 50. The front-end processor stage 40 divides the system into a number of effective pseudo arrays passing through output lines 111, 112, 113, each of which arrays have the same overall length as the original large array but have fewer elements.

Figure 3B:
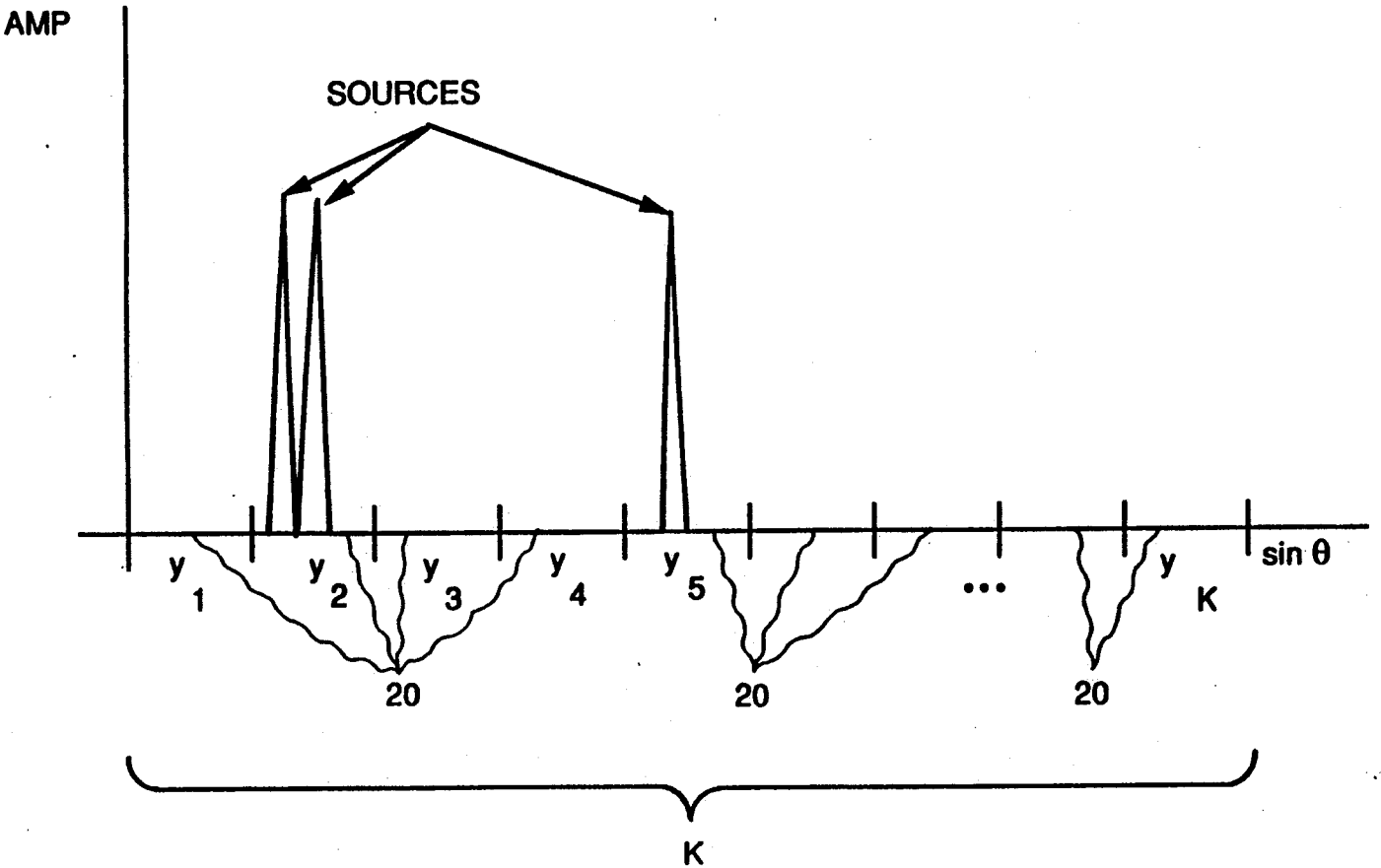
FIG. 3*b* illustrates division of the signal received from a coherent aperture into a plurality of sector with each sector e.g. the ith, represented by an N dimensional data vector $Y_i$.

The front-end processor stage 40 divides the first Nyquist interval of the full spectrum into K contiguous spectral sectors (20 of FIG. 3). All these spatial sector have equal spatial bandwidths δ. This is accomplished by feeding parallel branches 60 from large array x(n) through branches 61, 62 and 63 to modulator 71, 72 and 73, respectively. (Note that there are K branches of the present invention, but only four are shown in this illustration). The spatial spectrum of the large array x(n) is single sideband modulated downward in frequency by modulators 70 by the uniformly spaced complex modulation factor, $$W_K^{-KN} = \exp[-j2\pi kn/K], \text{ for } k=0,1,2,\ldots,K-1$$

$\pi$ being the ratio of the circumference of a circle to its diameter, and $j=\sqrt{-1}$ Modulator 71 passes the original signal through without modification. Modulator 72 multiplies the signal by a factor of $\exp[-j2\pi n/K]$. Modulator 73 multiplies the signal by $$\exp[-j2\pi 2n/K].$$

The signal is then low pass filtered by finite impulse response (FIR) filters 90 with an impulse response function given by h(n). In this embodiment, all the sectors 20 are generated by identical low pass filters. The signal from modulator 71 is low pass filtered by filter 91. The signal from modulator 72 is low pass filtered by filter 92. The signal from modulator 73 is low pass filtered by filter 93. It should be noted that filters 91, 92 and 93 are identical having an impulse response of h(n). The output signals of filters 91, 92 and 93 representing selective sectors of the original signal are fed to a decimator stage 100. The 30 decimator stage 100 discards many of the samples in order to reduce the number of samples from N to M. Output signals of decimator 101 are fed to a superresolution analyzer 51. Output signals of decimator 102 are fed to superresolution analyzer 52, and similarly the output signals of decimator 103 are fed to superresolution analyzer 53.

For ideal low pass filters with passbands of spatial spectral width δ, the uniform elemental spacing can be extended from $(\lambda_c/2 \rightarrow \lambda_c/2\delta)$ where $\lambda_c$ is the wavelength at the center of the passband. Filters are, of course, never ideal and to mitigate aliasing effects the filtered sector signals are usually oversampled. The element spacing for the pseudo-arrays becomes $\lambda_c/(\delta+\Delta)$, where delta is an incrimental spacing. By choosing $\lambda_c/(\delta+\Delta)$ to be an integer M this corresponds to decimating the original phased array consisting of N elements down to a pseudo-array consisting of M elements.

The order of the low pass FIR filters 90 cannot exceed the element order of the original large array. For these systems, the N point digital Fourier Transform (DFT) low pass filter represents a near ideal choice. Consider the division of the spectrum into K contiguous spatial spectral sectors. The kth spatial spectral sector will have a central frequency given by $f_k=k/K$. For an even number N, the sectors for $k > K/2$ correspond to the negative frequency sectors contained within the first Nyquist interval. For special sideband reduction effects, the N point DFT tap weights can be modified by multiplicative tapering functions. The N point DFT of the modulated sequence for the kth spatial spectral sector is given by $$X_k(q) = \sum_{n=0}^{N-1} e^{-j2\pi n(q/N+k/K)} x(n) \tag{2}$$

where q is the index of the output.

The filtered pseudo phased array relevant to the kth spectral sector employs a selected P of these outputs. It is given by $$\begin{aligned} Z_k(m) &= \frac{1}{N} \sum_{q=-P/2}^{+P/2-1} e^{j2\pi qm/N} X_k(q) \\ &= \frac{1}{N} \sum_{n=0}^{N-1} x(n) e^{-j2\pi kn/K} e^{-j\pi(m-n)/N} \frac{\sin\pi(m-n)P/N}{\sin\pi(m-n)/N}, \\ &\quad m = 0, 1, 2, \ldots, N-1 \end{aligned} \tag{3}$$

From this expression, we see that the impulse response function for the DFT low pass filter of spatial spectral width $P/N=1/K$ is given by $$h(n) = e^{-j\pi n/N} \frac{\sin \pi nP/N}{\sin \pi n/N} \tag{4}$$

Therefore the serial operations involving single sideband modulation, followed by low pass filtering, followed by decimation generates K different Mth order sequences $\{Z_k[m=1K], 1=0,1, \ldots, M-1,\}$ which represent the complex signals from the different elements in the pseudo-phased arrays. By choosing $M > P$, the aliasing effects from the sidebands of the DFT filters can be reduced. The preprocessor has effectively reduced the order of the phased arrays down to a level $N \rightarrow M$ where the matrix operations required for the superresolution stage of the spatial spectrum analyzer are now practicable.

Figure 5:
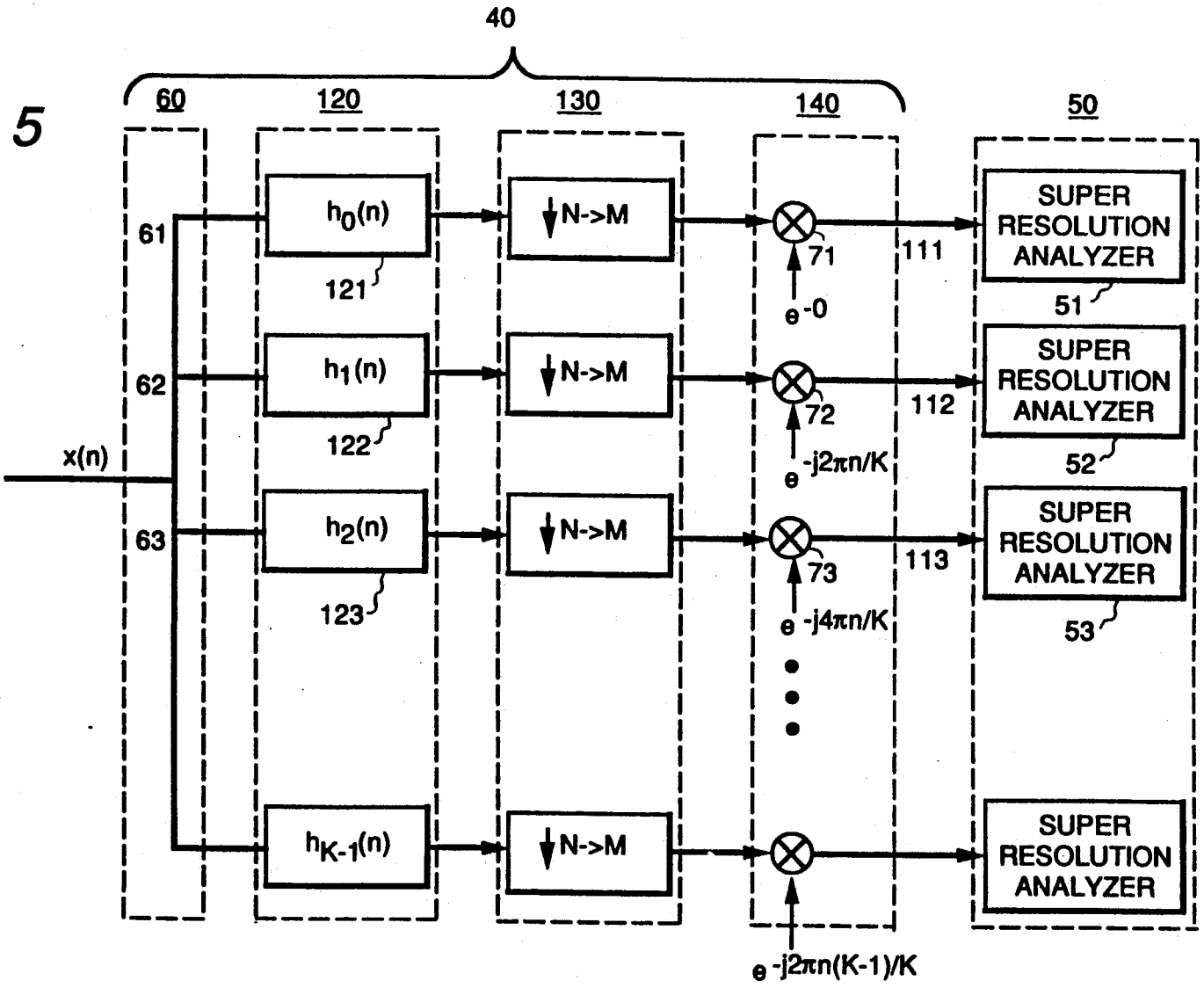
FIG. 5 is a partial block diagram of a second embodiment of the present invention.

An alternative architecture which accomplishes the same end result for the Mth order pseudo arrays is illustrated in FIG. 5 Here filtering 120 and decimation 130 precedes the modulation operation. This embodiment requires fewer complex multiplications because the modulation operation 140 is performed on the decimated array from decimators 130 rather than on the original full length array 10 illustrated as input signal x(n). The tradeoff lies in the fact that the embodiment of FIG. 5 architecture requires bandpass filters 121, 122, 123 for each sector that are different from each other. (Note that there are K sector and parallel branches, but only several are shown here.) Therefore this architecture demands an increase in memory in order to store a set of filter coefficients, used in filters 121, 122, 123.

Figure 6:
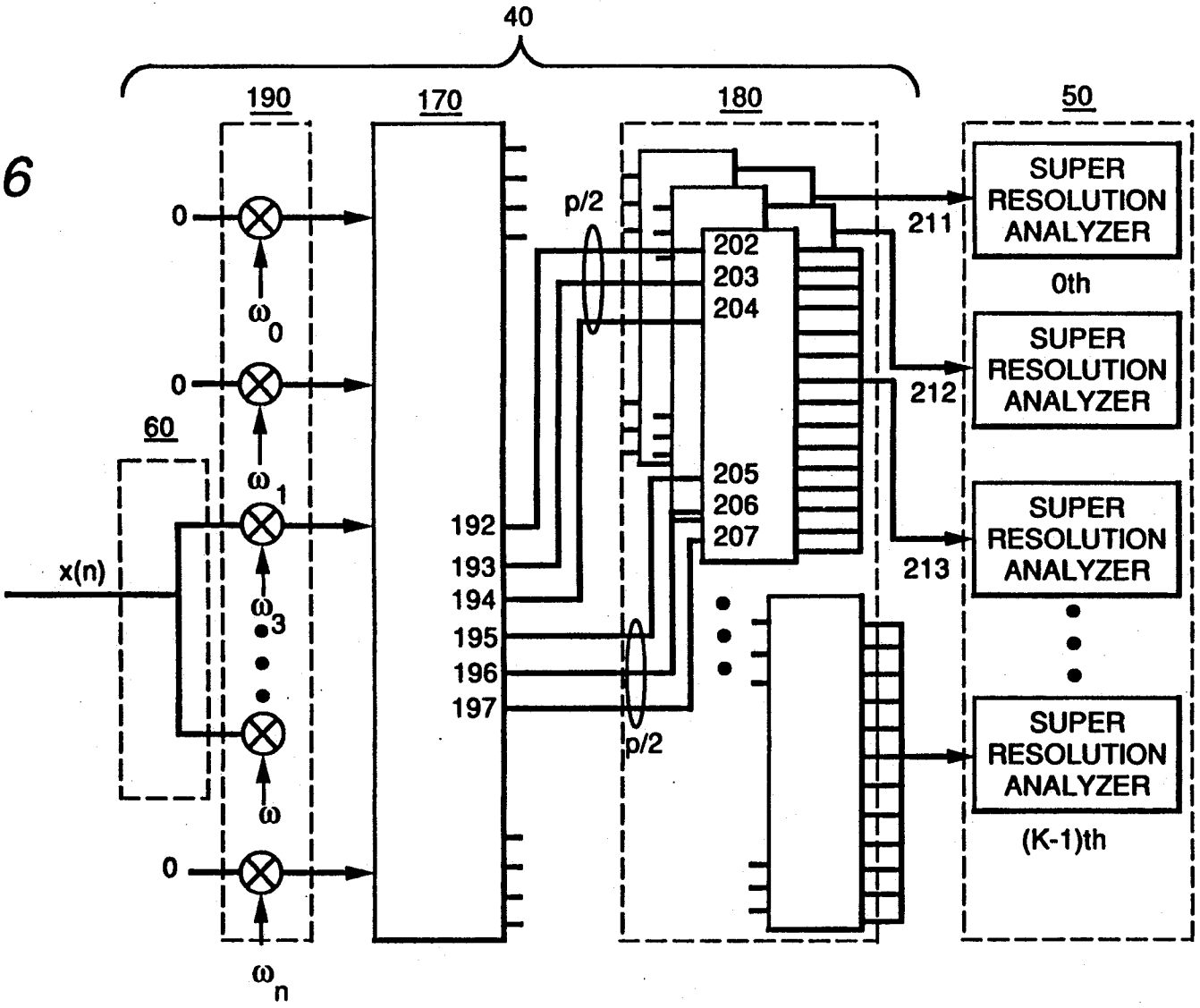
FIG. 6 is a partial block diagram of a third embodiment of the present invention.
Figure 7:
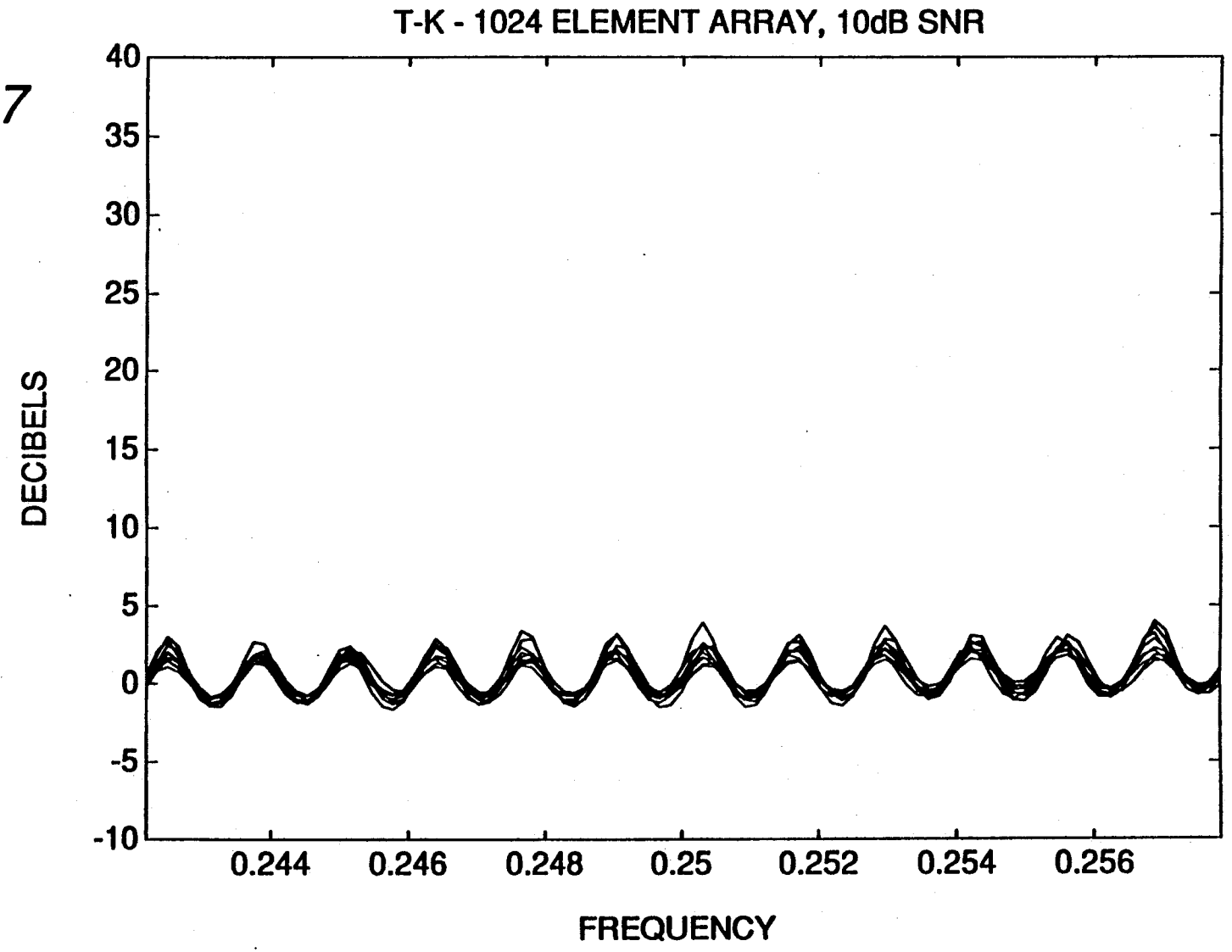
FIGS. 7, 8, 9, and 10 illustrate simulation results obtained for the present invention utilizing the Tufts-Kumaresan algorithm.
Figure 8:
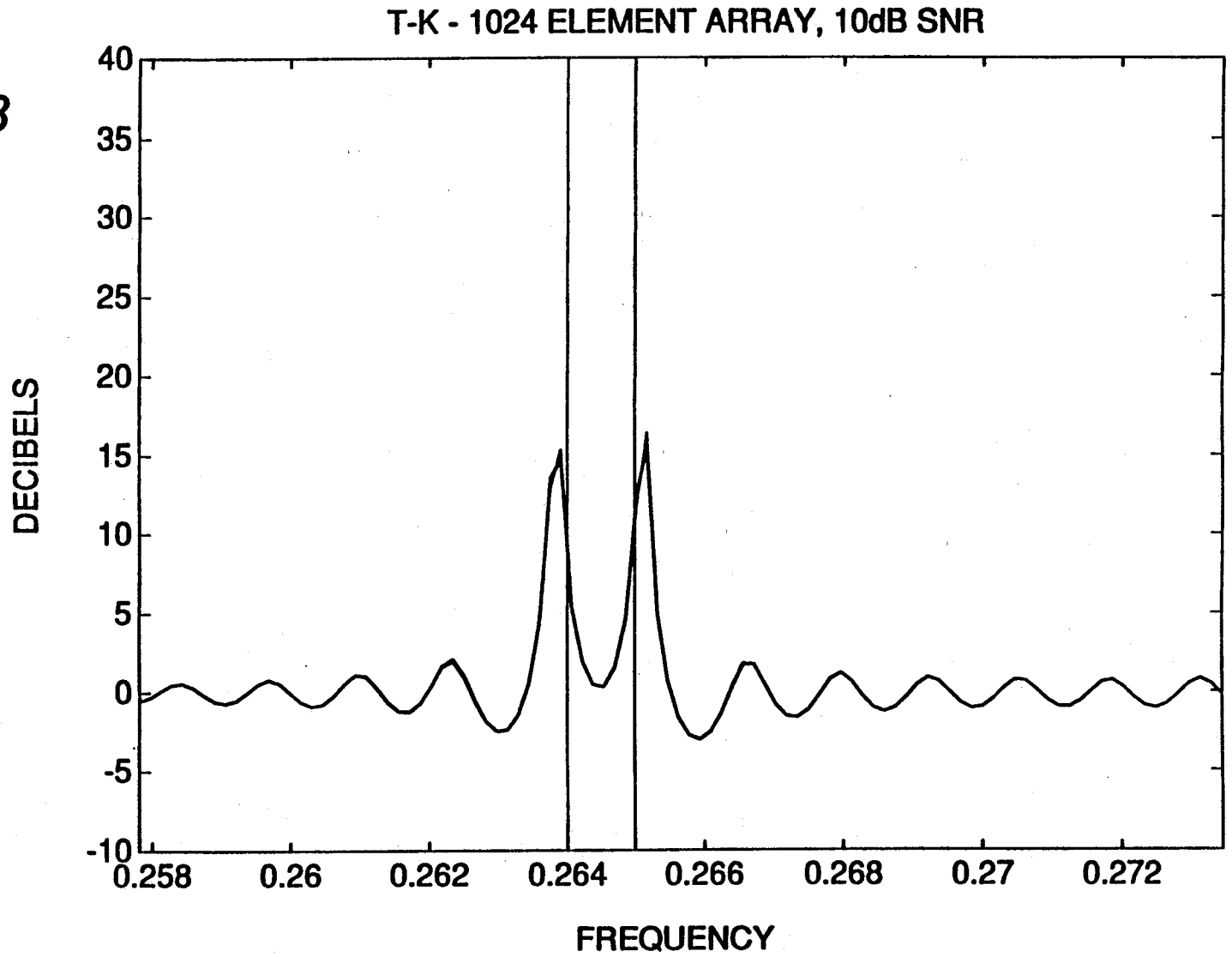
Figure 9:
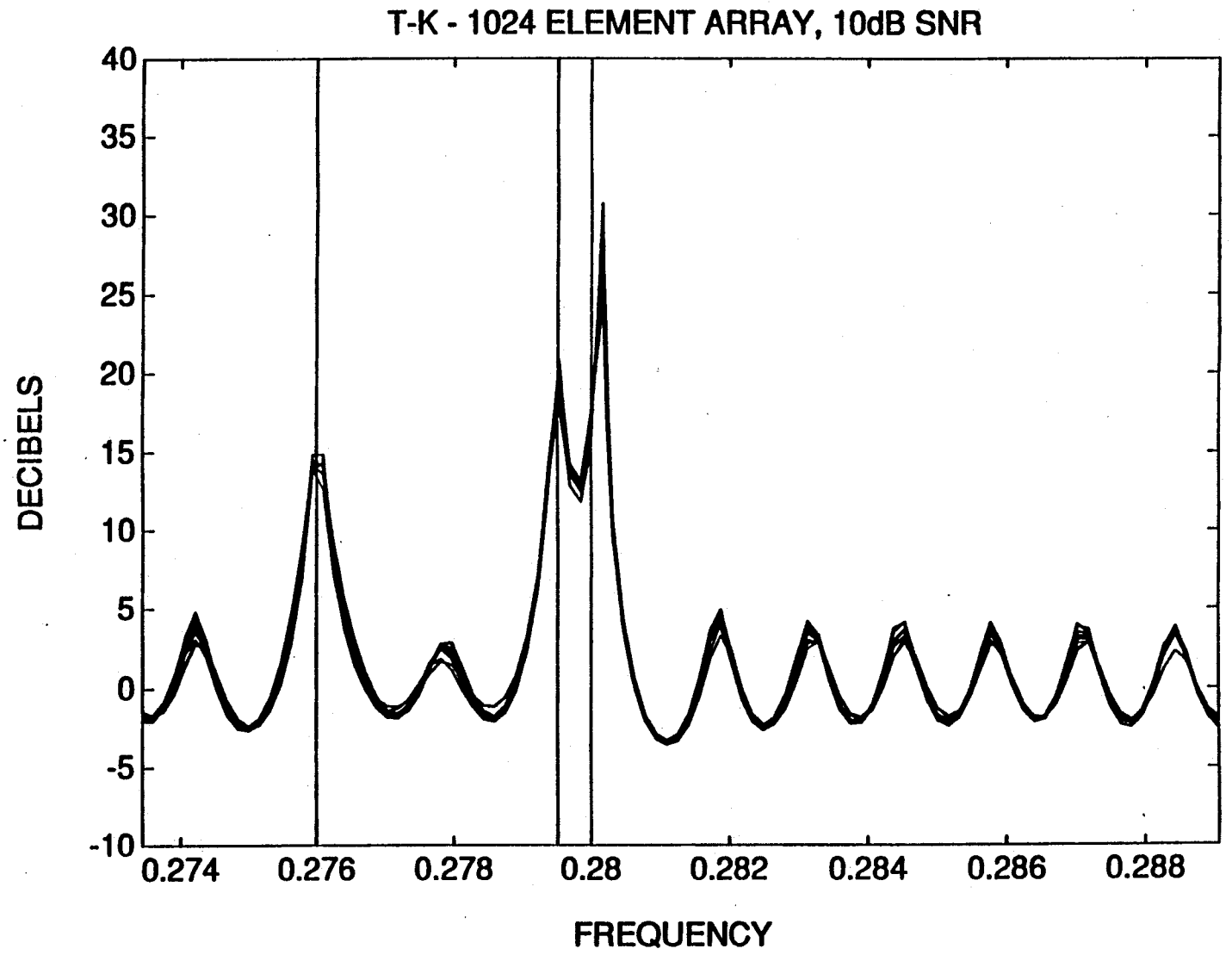
Figure 10:
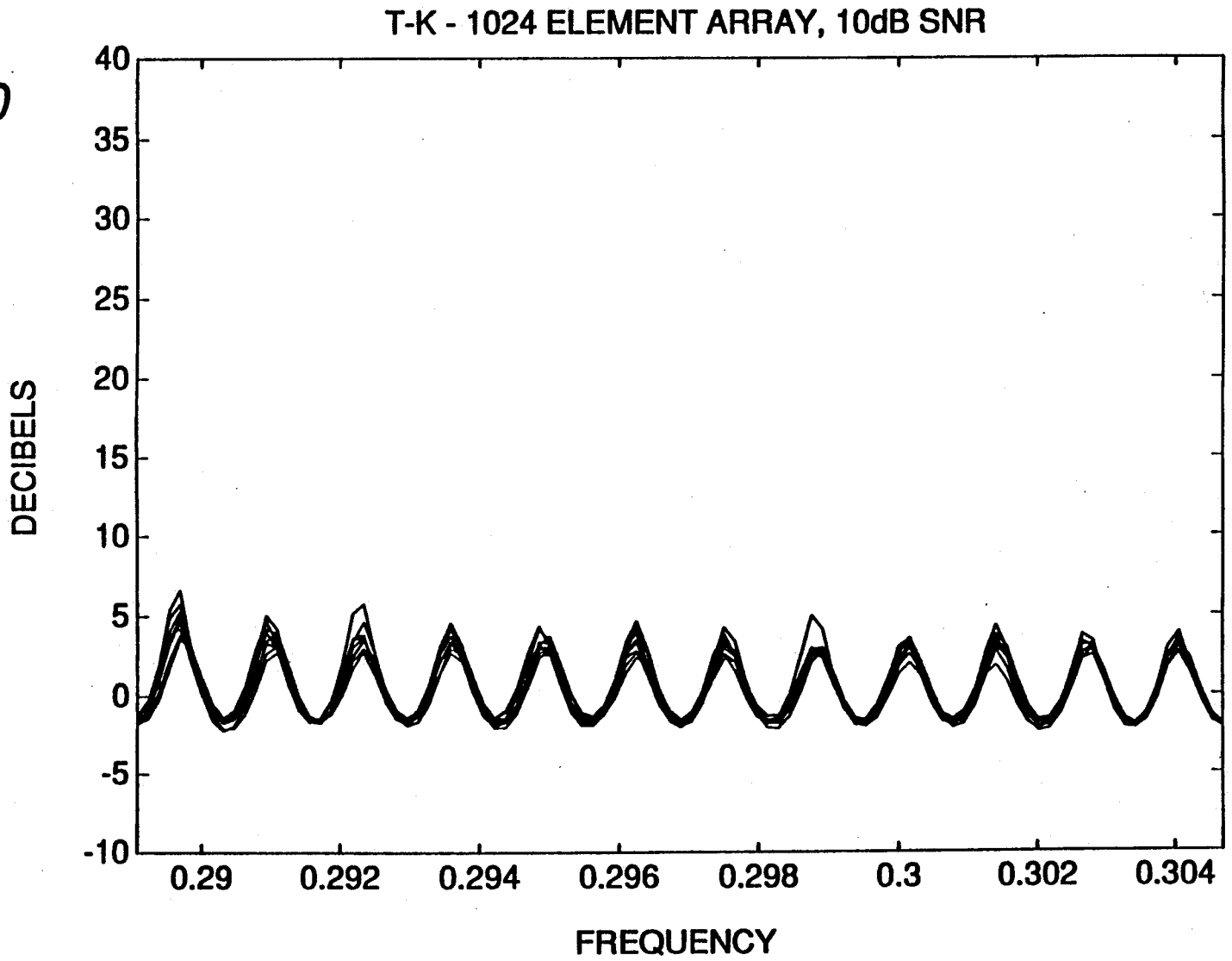
Figure 11:
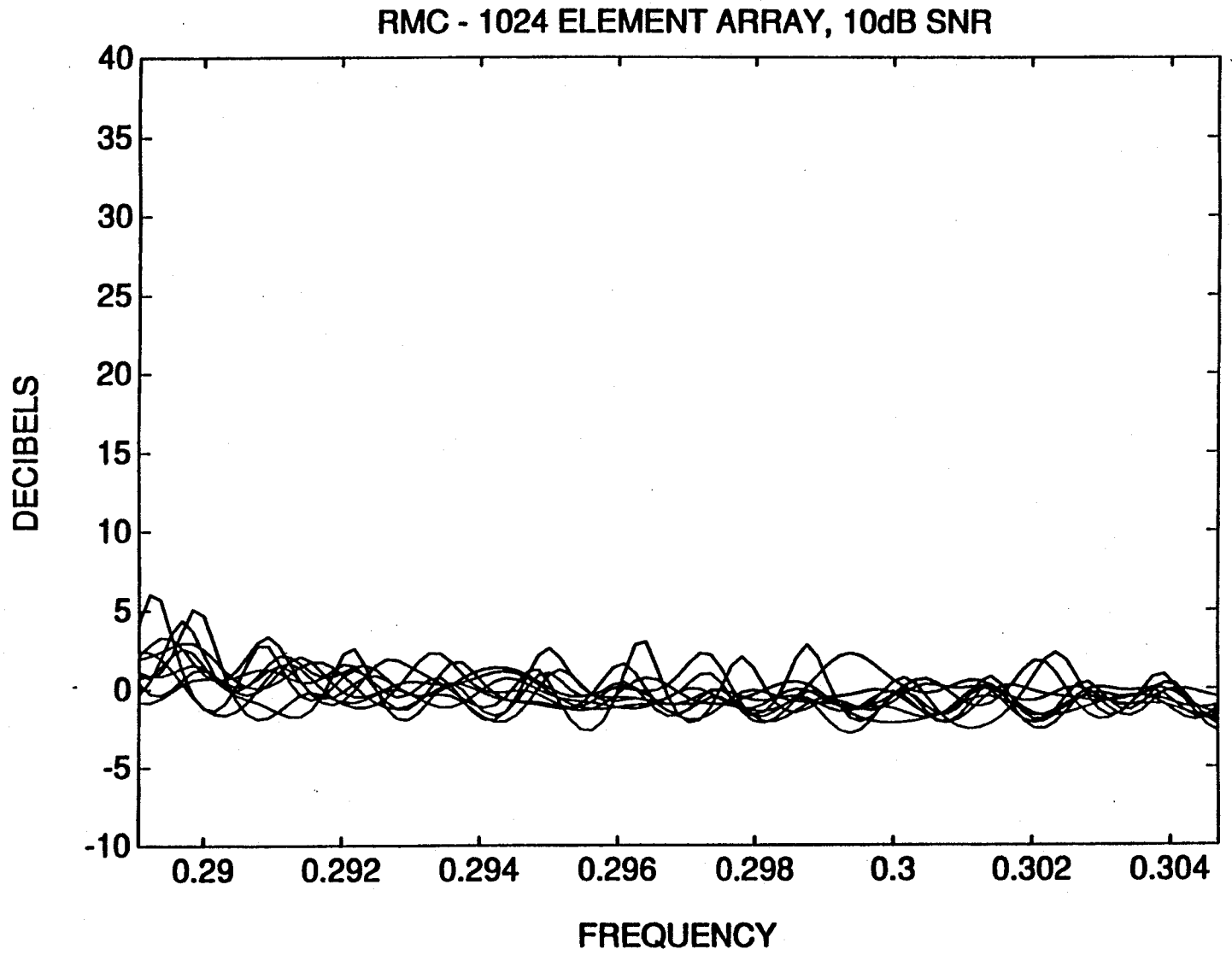
FIGS. 11, 12, 13, and 14 represent simulation results obtained for the present invention utilizing the LMFE algorithm.
Figure 12:
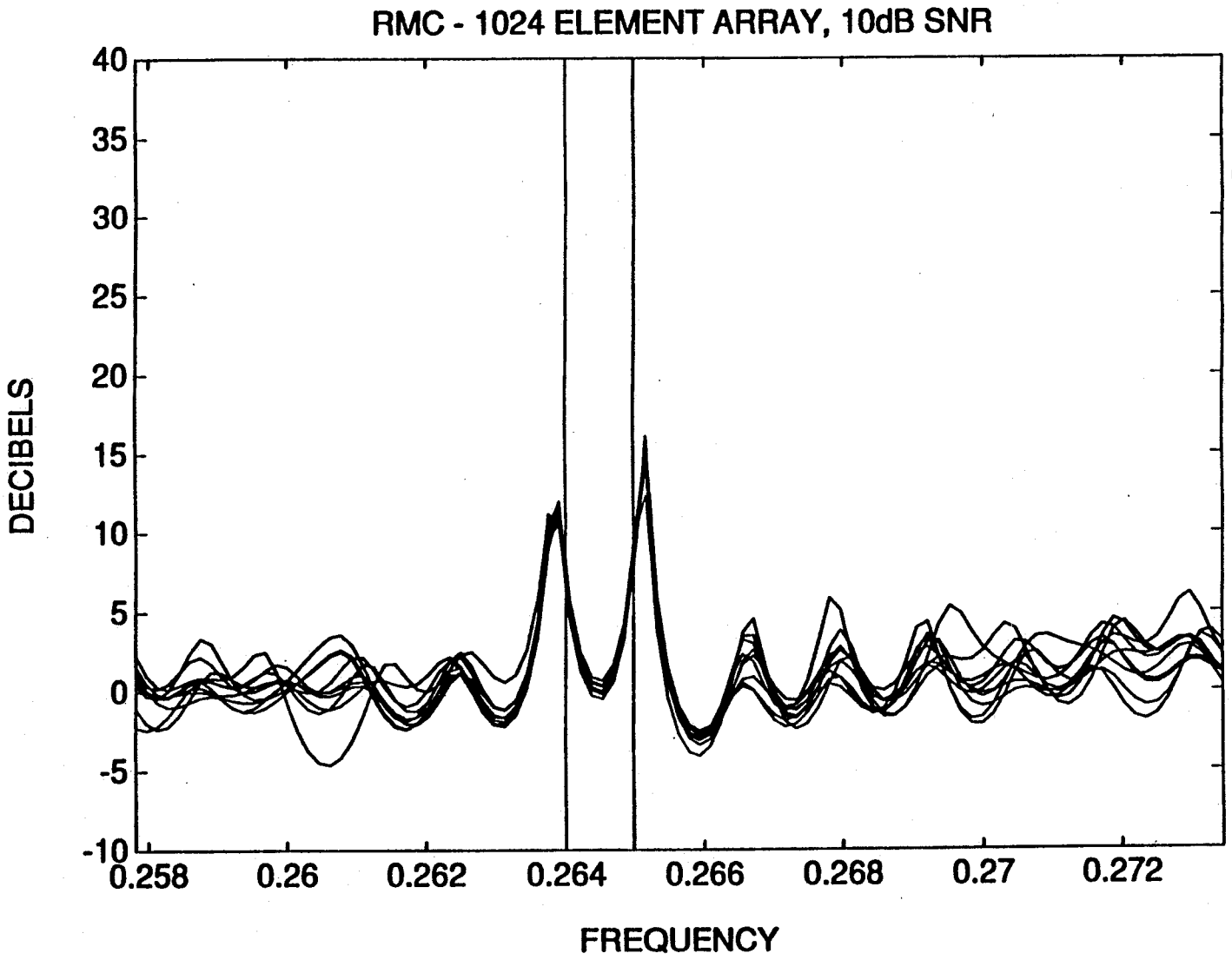
Figure 13:
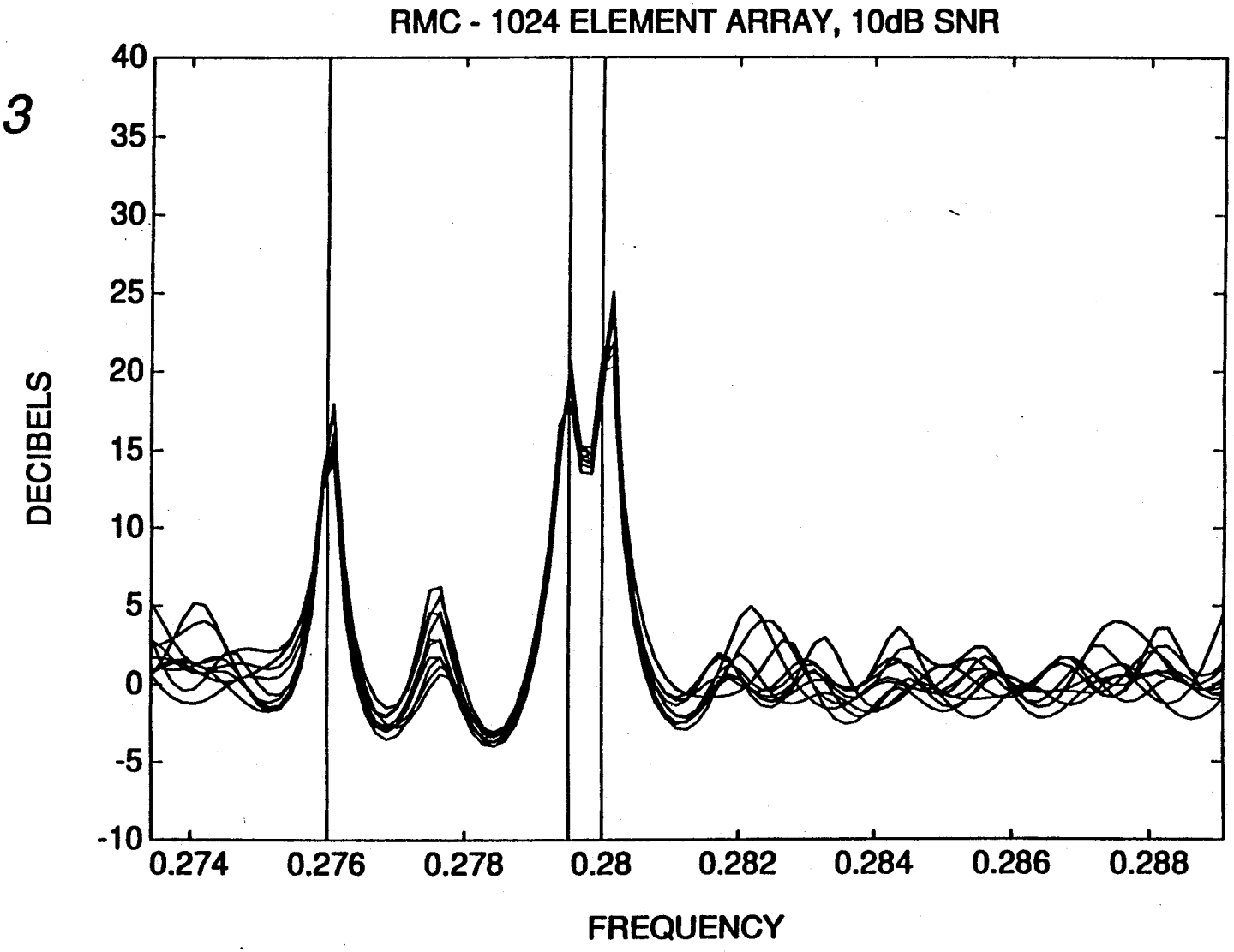
Figure 14:
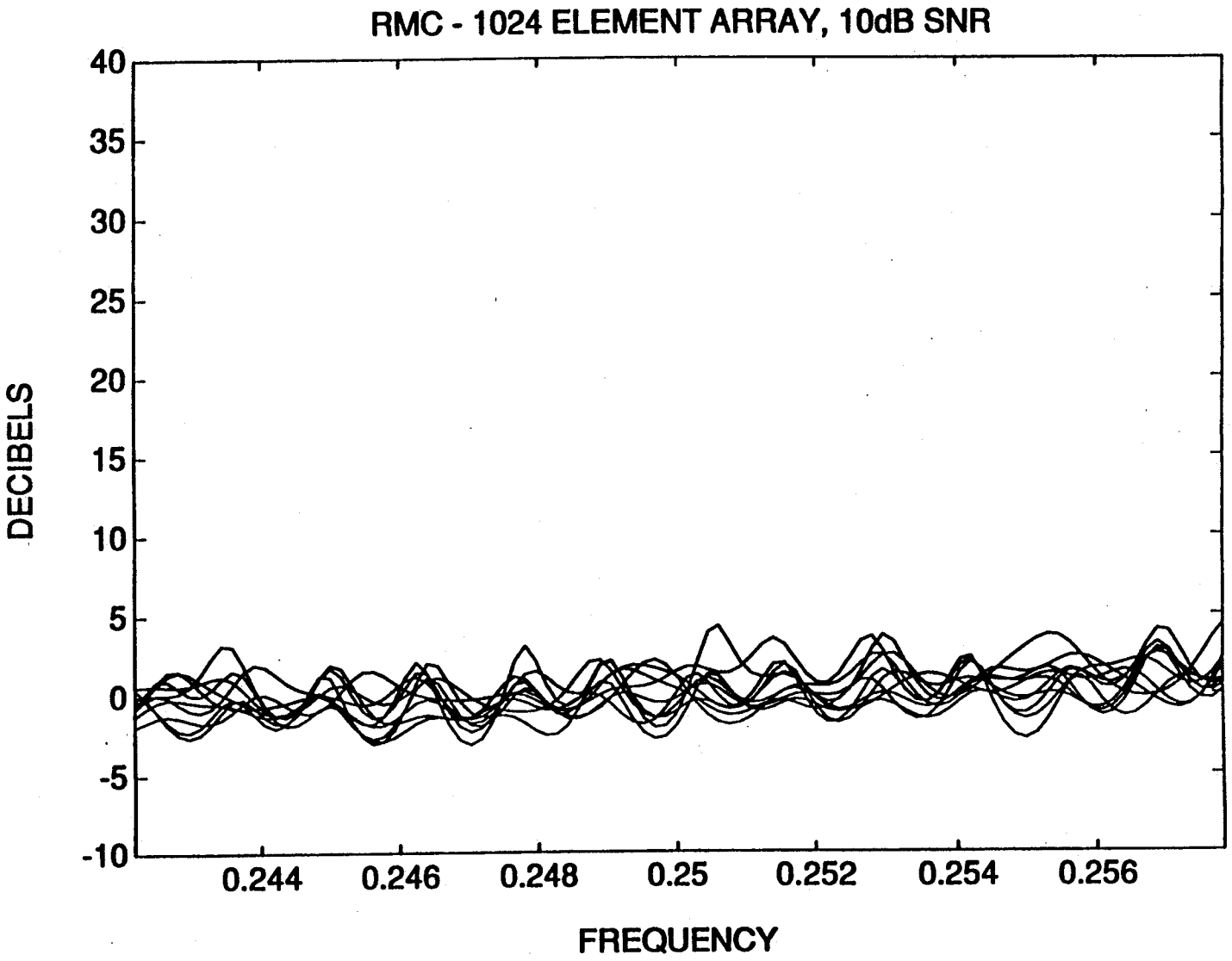

Another embodiment shown in FIG. 6 is similar to that of FIG. 5 in that filters 120 precede modulation 140, just as filters 170 in the embodiment of FIG. 6 preceed modulation 180. The embodiment of FIG. 6 differs from the embodiment of FIG. 5 in that the filters 120 are provided by DFT 170 and inverse digital Fourier Transform (IDFT) 180 structures. Each input x(n) may be "windowed" by a window function multiplier 190 ω(n) prior to being supplied to an Nth order DFT structure 170 to improve sidelobe leakage. In this architecture N is defined as being a power equal to the nearest power of two larger than the size of large array 10. These added input signals are "zero padded" to fill the inputs of 170. The outputs of DFT 170 are grouped into K groups of P output signals to form the desired spatial spectral response of a pseudo-array 212. Output signals centered at higher spatial frequencies are demodulated to baseband by simply interchanging their index value to the baseband indices. Stated differently, the interconnections between the individual DFT outputs 192, 193, 194, 195, 196, 197 and IDFTs 202, 203, 204, 205, 206, 207 are shifted so that the desired sector is centered about the baseband input signals. The system requires only one Nth order DFT structure 70, but requires K distinct IDFT 180 structures each of width M corresponding to the K desired pseudo-arrays.

Spatial decimation is accomplished by simply choosing the set of M outputs of the IDFT structure. As before, we have implemented the steps of filtering, demodulation, and decimation to provide K pseudo-arrays each with M complex samples values which are then supplied into the superresolution stage of the spectrum analyzer.

The superresolution spectrum analyzer stage 50 processes the reduced order sampled data sequences from the sectors.

For problems involving point sources, a variety of different algorithms can be used in the superresolution subsystem stage of the analyzer. For example, for direction of arrival (DOA) analyses of targets in surveillance systems, the superresolution stage can effectively deploy generic signal/noise subspace analyzers using the MUSIC/Root-MUSIC (See "Multiple Emitter Location and Signal Parameter Estimation", R. O. Schmidt, IEEE Trans. Antennas and Propagation, Vol. AP-34, pp. 276-280, Mar. 1986), or ESPRIT subspace algorithms, (See "ESPRIT - A Subspace Rotational Approach to Estimation of Parameters of Cisoids in Noise", Roy, R. A. Paulraj, and T. Kailath, IEEE Trans. on ASSP, Vol. 34, 1340-1342, Oct. 1986). Alternatively, for scenarios involving low snapshot data, signal subspace analyzers of the Tufts-Kumaresan (T-K) form can be effectively depolyed. (See "Estimation of Frequencies of Multiple Sinusoids: Making Linear Prediction Perform Like Maximum Likelihood", Tufts, D. W., and R. Kumaresan, Proc. IEEE, Vol. 70, pp. 975-989, Sept. 1982). For scenarios involving low snapshot data and image scenes involving continuous as well as point sources, either the non-linear (See "Robust Spectral Estimation: Autocorrelation Based Minimum Free Energy Method", S. D. Silverstein and J. M. Pimbley, Proc. 22nd Asilomar Conf. on Signals, Systems, and Computers, Nov.1988, "Performance Comparisons of the Minimum Free Energy Algorithms with the Reduced Rank Modified Covariance Eigenanalysis Algorithm," S. D. Silverstein, S. M. Carroll, and J. M. Pimbley, in *Proc. ICASSP*, Glasgow, Scotland, U.K., May 1989) or linear minimum free energy (MFE) noise reduction extensions of the autoregressive algorithms which have been recently developed by Silverstein et al. above can also be deployed either for a DOA mission or for a more general coherent imaging mission. The MFE extensions of the autoregressive algorithms are the preferred approaches for solving coherent imaging problems because of their inherent ability to resolve combination spectra for situations involving sparse and/or noisy data as well as giving superior performance for replicating the relative intensity of different sources.

The validity of the architecture has been demonstrated by simulation. The simulations feature large array implementations of the T-K reduced rank modified covariance algorithm; and the linear MFE extension of the modified covariance algorithm. These algorithms are both capable of providing reasonably good frequency estimation performance for single snapshot data vectors at moderately low signal-to-noise-rations (SNR's). These algorithms use similar estimates of the single sample covariance matrix based upon forward and backward spatially smoothing. The simulations are based upon a 1024 element array suitably sampled at the Nyquist rate. The simulation test signal consists of five very narrow-band spectral sources represented mathematically by complex sinusoids at spatial frequencies $f_1=0.264$, $f_2=f_1+1/1024$, $f_3=0.276$, $f_4=0.28-0.5/1024$, and $f_5=0.28$. The frequencies $\{f_n\}$are expressed in units of the spatial Nyquist frequency. The single snapshot simulation uses a test signal where the line spectral sources all have equal complex amplitudes, hence the initial relative phases of the sources are the same. The Rayleigh spatial frequency resolution for this aperture is 1/1024. Hence frequencies $f_1$ and $f_2$ are separated by the Rayleigh resolution, and frequencies $f_4$ and $f_5$ are separated by ½ the Rayleigh resolution. The total signal is taken as a combination of the source signal plus additional uncorrelated random noise which is modeled as complex Gaussian white noise. The SNR is defined in terms of the ratio per element of the source energy for one of the sources to the noise energy per element. The simulations shown here are single coherent snapshot results (no noise averaging) at a SNR of 10 dB. FIGS. 7, 8, 9, 10 and 11, 12, 13, 14 illustrate the estimated spectra as spectral overlays for 10 spectral estimates of the source signal. Each estimate corresponds to a different realization of the random noise vectors.

The simulations use the parallel FFT/IFFT architecture where FFT's of the 1024 sample coherent aperture are performed. The transformed 1024 element vectors are then divided into 64 32-element "beam space" vectors commensurate with 50% spectral overlap. The next step involves a 32-point IFFT which automatically generates the decimated data vector for the 32 element pseudo-arrays. In both the T-K and MFE algorithms, twenty-fourth order modified covariance matrices were constructed from the pseudo-array data vectors.

The simulation results will feature "spatial spectral" constructions for four contiguous sectors. The spectral reconstructions are not true spectra, but rather represent peaks from which line spectral source frequencies can be estimated. FIGS. 7, 8, 9, and 10 illustrate the simulation results for the T-K algorithm. Four contiguous sectors having increasing frequencies are shown in FIGS. 7, 8, 9, and 10 respectively. Similarly, the simulation results for the linear MFE algorithm for four contiguous sectors having increasing frequencies are shown in FIGS. 11, 12, 13, and 14 respectively. The first and last sectors (FIGS. 7, 10 and 11, 14) in each series exhibit no sources. The second sector in the series (FIGS. 8 and 12) illustrates the peaks for the two sources separated by 1/1024, and the third subband in the series (FIGS. 9 and 13) illustrates a single source and two sources separated by 0.5/1024. The actual source frequencies are indicated by the vertical lines in the spectral plots. These simulation results show no sign of any aliasing effects for any of the sectors associated with the spectral regions outside the illustrated domain.

While the architecture has been demonstrated in conjunction with T-K and linear MFE Superresolution algorithms, other superresolution algorithms may also be employed, as mentioned above. Of special interest are the MUSIC and ESPIRIT superresolution algorithms when utilized in conjunction with the embodiment shown in FIG. 6. In this instance, the multiple IDFT structures may be eliminated and their functions provided by the superresolution analysis.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

What we claim is:

1. A superresolution beamformer for preprocessing coherent aperture data comprising:

a plurality of parallel branches, each branch having a modulator, a filter adapted to pass a predetermined bandwidth, a decimator, and an output, the modulator of the first branch coupled to receive a signal from the coherent aperture and pass the signal, the modulator of the second branch coupled to receive the signal from the coherent aperture and shift the signal by a factor of exp $[-j2\pi n/k]$, where $$j=\sqrt{-1};$$

$\pi$ is the ratio of the circumference of a circle to its diameter;

n=the index number of the signal sample and

K=the number of parallel branches in the superresolution beamformer;

the modulator of the third branch of the superresolution beamformer coupled to receive the signal and shift the signal by a factor of $\exp[-j4\pi n/K]$, the modulator of the Kth branch of the superresolution beamformer coupled to receive the signal and shift the signal by a factor of exp $[-j2\pi kn/K]$, and the modulator of the last branch of the superresolution beamformer coupled to receive the signal and shift the signal by a factor of exp $[-j2\pi kn(K-1)/K]$;

the filter being operable to filter out selected frequencies of a signal it receives, said decimator being operable to discard selected samples of the signal received from the filter reducing the number of samples and passing these samples to its corresponding output of the branch; and the output of each branch being coupled to a corresponding superresolution analyzer used in constructing the spacial signal spectrum from the coherent aperture.

2. A superresolution beamformer for preprocessing data from a coherent aperture comprising:

a plurality of windowing elements each receiving the signal from the coherent aperture;

a digital Fourier transform (FFT) element for receiving and Fourier Transforming the output signal of each of the windowing elements into a set of Fourier coefficients;

a plurality of inverse digital Fourier transform (IDFT) elements each being operable to receive a portion of the output signal of the digital Fourier transform elements, so as to cause decimation of the output signal, each of the IDFTs being operable to produce as an output signal the inverse digital Fourier transform of the input signal; and a plurality of superresolution analyzers, selected outputs from the IDFT elements being coupled to a corresponding superresolution analyzer, respectively, each of the superresolution analyzers being operable to construct a portion of the spatial signal spectrum from the coherent array.

3. A superresolution beamformer for preprocessing data from a coherent aperture comprising:

a plurality of windowing elements for receiving a signal from the coherent aperture;

a digital Fourier transform element for receiving and Fourier Transforming the output signal of each of the windowing elements; and a plurality of superresolution analyzers for employing subspace. algorithms, selected outputs from each digital Fourier transform element being coupled to each corresponding one of said plurality of superresolution analyzers, respectively such that each of the superresolution analyzers each may construct a portion of an output signal representing said data from said coherent aperture.

4. A superresolution beamformer for preprocessing data from a coherent aperture as recited in claim 3 wherein at least one of the superresolution analyzers is particularly adapted for use with a signal subspace algorithm.

5. A superresolution beamformer for preprocessing data from a coherent aperture as recited in claim 4 wherein the signal subspace algorithm is the MUSIC algorithm.

6. A superresolution beamformer for preprocessing data from a coherent aperture as recited in claim 4 wherein the signal subspace algorithm is the ESPRIT algorithm.

7. A superresolution beamformer for preprocessing coherent aperture data and having a plurality of parallel branches, each branch comprising:

a) a bandpass filter coupled to receive the signal from the coherent aperture and to filter the signal;

b) a decimator coupled to receive the signal from its corresponding bandpass filter for discarding selected samples of the signal so as to reduce the number of samples;

c) a modulator coupled to receive the signal from the decimator, the modulator of the first branch being operable to pass the signal, the modulator of the second branch being operable to shift the signal by a factor of $\exp[-j2\pi n/K]$, where $$j=\sqrt{-1};$$

$\pi$ is the ratio of the circumference of a circle to its diameter;

n=the index number of the signal sample and

K=the number of parallel branches in the superresolution beamformer;

the modulator of the third branch being operable to shift the signal by a factor of $\exp[-j4\pi n/K]$, the modulator of the kth branch of the superresolution beamformer being operable to shift the signal by a factor of $\exp[-j2\pi kn/K]$, and the modulator of the last branch being operable to shift the signal by a factor of $\exp[-j2\pi kn(K-1)/K]$;

d) a superresolution analyzer for constructing the spacial signal spectrum from the coherent aperture; and e) a branch output for sending the signal from its corresponding modulator to the superresolution analyzer.

8. A superresolution beamformer for preprocessing coherent aperture data and having a plurality of parallel branches, each branch comprising:

a) a modulator, the modulator of the first branch being coupled to receive a signal and pass the signal, the modulator of the second branch being coupled to receive the signal and shifting the signal by a factor of exp[$-j2\pi n/K$], where $$j = \sqrt{-1};$$

$\pi$ is the ratio of the circumference of a circle to its diameter;

n = the index number of the signal sample and

K = the number of parallel branches in the superresolution beamformer;

the modulator of the third branch of the superresolution beamformer coupled to receive the signal and shift the signal by a factor of exp [$-j4\pi n/K$], the modulator of the kth branch of the superresolution beamformer coupled to receive the signal and shift the signal by a factor of exp [$-2\pi kn/K$], and the modulator of the last branch of the superresolution beamformer coupled to receive the signal and shift the signal by a factor of exp [$-j2\pi kn\ (K-1)/K$];

b) a low pass filter coupled to receive the signal from its corresponding modulator and to low pass filter the signal;

c) a decimator coupled to receive the signal from its corresponding low pass filter for discarding selected samples of the signal so as to reduce the number of samples; and d) a superresolution analyzer for constructing a spacial signal spectrum from the signal that has been shifted, low pass filtered, and decimated.

9. The superresolution beamformer of claim 2 wherein the IDFT elements are adapted to cause demodulation of its received signal to baseband by providing a subset of the Fourier coefficients from the FFT element corresponding to a desired spacial sector, to an IDFT element such that the Fourier coefficients are centered about a baseband frequency.

* * * * *